US010590759B2

(12) United States Patent
Ertas et al.

(10) Patent No.: US 10,590,759 B2
(45) Date of Patent: Mar. 17, 2020

(54) ZONAL ISOLATION DEVICES INCLUDING SENSING AND WIRELESS TELEMETRY AND METHODS OF UTILIZING THE SAME

(71) Applicants: Mehmet Deniz Ertas, Bethlehem, PA (US); Paul E. Pastusek, The Woodlands, TX (US); Mark M. Disko, Glen Gardner, NJ (US)

(72) Inventors: Mehmet Deniz Ertas, Bethlehem, PA (US); Paul E. Pastusek, The Woodlands, TX (US); Mark M. Disko, Glen Gardner, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/665,936

(22) Filed: Aug. 1, 2017

(65) Prior Publication Data

US 2018/0058198 A1 Mar. 1, 2018

Related U.S. Application Data

(60) Provisional application No. 62/381,335, filed on Aug. 30, 2016, provisional application No. 62/381,330,
(Continued)

(51) Int. Cl.
*E21B 47/12* (2012.01)
*E21B 47/14* (2006.01)
(Continued)

(52) U.S. Cl.
CPC ..... *E21B 47/12* (2013.01); *E21B 33/12* (2013.01); *E21B 34/06* (2013.01); *E21B 47/06* (2013.01);
(Continued)

(58) Field of Classification Search
CPC ..... E21B 47/12; E21B 47/06; E21B 47/10; E21B 47/065; E21B 47/14; E21B 47/18;
(Continued)

(56) References Cited

U.S. PATENT DOCUMENTS

| | | | | |
|---|---|---|---|---|
| 3,103,643 | A | 9/1963 | Kalbfell | 340/17 |
| 3,205,477 | A | 9/1965 | Kalbfell | 340/18 |

(Continued)

FOREIGN PATENT DOCUMENTS

| | | | | |
|---|---|---|---|---|
| CN | 102733799 | 6/2014 | ..... | E21B 47/16 |
| EP | 0636763 | 2/1995 | ..... | E21B 47/12 |

(Continued)

OTHER PUBLICATIONS

U.S. Appl. No. 15/666,334, filed Aug. 1, 2017, Walker, Katie M. et al.

(Continued)

*Primary Examiner* — Adnan Aziz
(74) *Attorney, Agent, or Firm* — ExxonMobil Upstream Research Company-Law Department

(57) ABSTRACT

Zonal isolation devices including sensing and wireless telemetry and methods of utilizing the same are disclosed herein. The zonal isolation devices include an isolation body, a sensor, and a wireless telemetry device. The zonal isolation devices may be incorporated into a hydrocarbon well that also includes a wellbore and a wireless data transmission network. The methods include methods of conveying a wireless signal within a well. The methods include detecting a property of the well, transmitting a wireless output signal, conveying the wireless output signal, and receiving the wireless output signal.

25 Claims, 5 Drawing Sheets

Related U.S. Application Data filed on Aug. 30, 2016, provisional application No. 62/428,367, filed on Nov. 30, 2016, provisional application No. 62/428,374, filed on Nov. 30, 2016, provisional application No. 62/428,385, filed on Nov. 30, 2016, provisional application No. 62/433,491, filed on Dec. 13, 2016.

(51) Int. Cl.

| | |
|---|---|
| ***E21B 47/18*** | (2012.01) |
| ***E21B 47/10*** | (2012.01) |
| ***E21B 47/06*** | (2012.01) |
| ***E21B 33/12*** | (2006.01) |
| ***E21B 34/06*** | (2006.01) |
| ***E21B 49/08*** | (2006.01) |

(52) U.S. Cl.

CPC ..... *E21B 47/065* (2013.01); *E21B 47/10* (2013.01); *E21B 47/122* (2013.01); *E21B 47/14* (2013.01); *E21B 47/18* (2013.01); *E21B 49/08* (2013.01); *E21B 2049/085* (2013.01)

(58) Field of Classification Search

CPC ..... E21B 47/122; E21B 49/08; E21B 34/06; E21B 33/12; E21B 2049/085; E21B 33/1208

See application file for complete search history.

(56) References Cited

U.S. PATENT DOCUMENTS

| | | | | |
|---|---|---|---|---|
| 3,512,407 | A | 5/1970 | Zill | 73/152 |
| 3,637,010 | A | 1/1972 | Malay et al. | 166/51 |
| 3,741,301 | A | 6/1973 | Malay et al. | 166/191 |
| 3,781,783 | A | 12/1973 | Tucker | 340/18 |
| 3,790,930 | A | 2/1974 | Lamel et al. | 340/18 |
| 3,900,827 | A | 8/1975 | Lamel et al. | 340/18 |
| 3,906,434 | A | 9/1975 | Lamel et al. | 340/18 |
| 4,001,773 | A | 1/1977 | Lamel et al. | 340/18 |
| 4,283,780 | A | 8/1981 | Nardi | 367/82 |
| 4,302,826 | A | 11/1981 | Kent et al. | 367/82 |
| 42,989,711 | | 11/1981 | Shawhan et al. | 367/82 |
| 4,314,365 | A * | 2/1982 | Petersen | E21B 47/16 175/56 |
| 4,884,071 | A | 11/1989 | Howard | 340/854 |
| 4,962,489 | A | 10/1990 | Medlin et al. | 367/32 |
| 5,128,901 | A | 7/1992 | Drumheller | 367/82 |
| 5,136,613 | A | 8/1992 | Dumestre, III | 375/1 |
| 5,166,908 | A * | 11/1992 | Montgomery | E21B 47/124 310/328 |
| 5,182,946 | A | 2/1993 | Boughner et al. | 73/151 |
| 5,234,055 | A | 8/1993 | Cornette | 166/278 |
| 5,283,768 | A | 2/1994 | Rorden | 367/83 |
| 5,373,481 | A | 12/1994 | Orban et al. | 367/82 |
| 5,468,025 | A | 11/1995 | Adinolfe et al. | 285/114 |
| 5,480,201 | A | 1/1996 | Mercer | 294/67.31 |
| 5,495,230 | A | 2/1996 | Lian | 340/551 |
| 5,569,240 | A | 10/1996 | Campbell | 227/130 |
| 5,592,438 | A | 1/1997 | Rorden et al. | 367/83 |
| 5,667,650 | A | 9/1997 | Face et al. | 204/298.07 |
| 5,850,369 | A | 12/1998 | Rorden et al. | 367/83 |
| 5,857,146 | A | 1/1999 | Kido | 455/38.3 |
| 5,924,499 | A | 7/1999 | Birchak et al. | 175/40 |
| 5,960,883 | A | 10/1999 | Tubel et al. | 166/313 |
| 5,995,449 | A | 11/1999 | Green et al. | 367/83 |
| 6,049,508 | A | 4/2000 | Deflandre | 367/48 |
| 6,125,080 | A | 9/2000 | Sonnenschein et al. | 367/134 |
| 6,128,250 | A | 10/2000 | Reid et al. | 367/153 |
| 6,177,882 | B1 | 1/2001 | Ringgenberg et al. | 340/853.7 |
| 6,236,850 | B1 | 5/2001 | Desai | 455/343 |
| 6,239,690 | B1 | 5/2001 | Burbidge et al. | 340/10.33 |
| 6,300,743 | B1 | 10/2001 | Patino et al. | 320/106 |
| 6,320,820 | B1 | 11/2001 | Gardner et al. | 367/81 |
| 6,324,904 | B1 | 12/2001 | Ishikawa et al. | 73/152.03 |
| 6,360,769 | B1 | 3/2002 | Brisco | 137/268 |
| 6,394,184 | B2 | 5/2002 | Tolman et al. | 166/281 |
| 6,400,646 | B1 | 6/2002 | Shah et al. | 367/82 |
| 6,429,784 | B1 | 8/2002 | Beique et al. | 340/853.2 |
| 6,462,672 | B1 | 10/2002 | Besson | 340/853.2 |
| 6,543,538 | B2 | 4/2003 | Tolman et al. | 166/284 |
| 6,670,880 | B1 | 12/2003 | Hall et al. | 336/132 |
| 6,679,332 | B2 | 1/2004 | Vinegar et al. | 166/373 |
| 6,695,277 | B1 | 2/2004 | Gallis | 241/191 |
| 6,702,019 | B2 | 3/2004 | Dusterhoft et al. | 166/278 |
| 6,717,501 | B2 | 4/2004 | Hall et al. | 336/132 |
| 6,727,827 | B1 | 4/2004 | Edwards et al. | 340/854.9 |
| 6,772,837 | B2 | 8/2004 | Dusterhoft et al. | 166/278 |
| 6,816,082 | B1 | 11/2004 | Laborde | 340/853.3 |
| 6,868,037 | B2 | 3/2005 | Dasgupta et al. | 367/54 |
| 6,880,634 | B2 | 4/2005 | Gardner et al. | 166/250.01 |
| 6,883,608 | B2 | 4/2005 | Parlar et al. | 166/278 |
| 6,899,178 | B2 | 5/2005 | Tubel | 166/313 |
| 6,909,667 | B2 | 6/2005 | Shah et al. | 367/83 |
| 6,912,177 | B2 | 6/2005 | Smith | 367/82 |
| 6,920,085 | B2 | 7/2005 | Finke et al. | 367/83 |
| 6,930,616 | B2 | 8/2005 | Tang et al. | 340/854.4 |
| 6,940,392 | B2 | 9/2005 | Chan et al. | 340/10.4 |
| 6,940,420 | B2 | 9/2005 | Jenkins | 340/855.6 |
| 6,953,094 | B2 | 10/2005 | Ross et al. | 166/381 |
| 6,956,791 | B2 | 10/2005 | Dopf et al. | 367/82 |
| 6,980,929 | B2 | 12/2005 | Aronstam et al. | 702/188 |
| 6,987,463 | B2 | 1/2006 | Beique et al. | 340/856.3 |
| 7,006,918 | B2 | 2/2006 | Economides et al. | 702/1 |
| 7,011,157 | B2 | 3/2006 | Costley et al. | 166/311 |
| 7,036,601 | B2 | 5/2006 | Berg et al. | 166/385 |
| 7,051,812 | B2 | 5/2006 | McKee et al. | 166/305.1 |
| 7,064,676 | B2 | 6/2006 | Hall et al. | 350/853.1 |
| 7,082,993 | B2 | 8/2006 | Ayoub et al. | 166/250.1 |
| 7,090,020 | B2 | 8/2006 | Hill et al. | 166/373 |
| 7,140,434 | B2 | 11/2006 | Chouzenoux et al. | 166/250.11 |
| 7,219,762 | B2 | 5/2007 | James et al. | 181/105 |
| 7,224,288 | B2 | 5/2007 | Hall et al. | 340/853.7 |
| 7,228,902 | B2 | 6/2007 | Oppelt | 166/250.02 |
| 7,249,636 | B2 | 7/2007 | Ohmer | 166/383 |
| 7,252,152 | B2 | 8/2007 | LoGiudice et al. | 166/386 |
| 7,257,050 | B2 | 8/2007 | Stewart et al. | 367/82 |
| 7,261,154 | B2 | 8/2007 | Hall et al. | 166/242.2 |
| 7,261,162 | B2 | 8/2007 | Deans et al. | 166/336 |
| 7,275,597 | B2 | 10/2007 | Hall et al. | 166/297 |
| 7,277,026 | B2 | 10/2007 | Hall et al. | 340/854.8 |
| RE40,032 | E | 1/2008 | van Borkhorst et al. | 455/343.2 |
| 7,317,990 | B2 | 1/2008 | Sinha et al. | 702/6 |
| 7,321,788 | B2 | 1/2008 | Addy et al. | 455/574 |
| 7,322,416 | B2 * | 1/2008 | Burris, II | E21B 23/00 166/308.1 |
| 7,325,605 | B2 | 2/2008 | Fripp et al. | 166/250.01 |
| 7,339,494 | B2 | 3/2008 | Shah et al. | 340/855.7 |
| 7,348,893 | B2 | 3/2008 | Huang et al. | 340/854.3 |
| 7,385,523 | B2 | 6/2008 | Thomeer et al. | 340/854.8 |
| 7,387,165 | B2 | 6/2008 | Lopez de Cardenas et al. | 166/313 |
| 7,411,517 | B2 | 8/2008 | Flanagan | 340/854.4 |
| 7,477,160 | B2 | 1/2009 | Lemenager et al. | 340/853.1 |
| 7,516,792 | B2 | 4/2009 | Lonnes et al. | 166/308.1 |
| 7,551,057 | B2 | 6/2009 | King et al. | 340/5.72 |
| 7,590,029 | B2 | 9/2009 | Tingley | 367/82 |
| 7,595,737 | B2 | 9/2009 | Fink et al. | 340/854.4 |
| 7,602,668 | B2 | 10/2009 | Liang et al. | 367/25 |
| 7,649,473 | B2 | 1/2010 | Johnson et al. | 340/853.1 |
| 7,750,808 | B2 | 7/2010 | Masino et al. | 340/572.1 |
| 7,775,279 | B2 | 8/2010 | Marya et al. | 166/297 |
| 7,787,327 | B2 | 8/2010 | Tang et al. | 367/27 |
| 7,819,188 | B2 | 10/2010 | Auzerais et al. | 155/250 |
| 7,828,079 | B2 | 11/2010 | Oothoudt | 175/20 |
| 7,831,283 | B2 | 11/2010 | Ogushi et al. | 455/574 |
| 7,913,773 | B2 | 3/2011 | Li et al. | 175/40 |
| 7,952,487 | B2 | 5/2011 | Montebovi | 340/636.1 |
| 7,994,932 | B2 | 8/2011 | Huang et al. | 340/854.3 |
| 8,004,421 | B2 | 8/2011 | Clark | 340/854.4 |
| 8,044,821 | B2 | 10/2011 | Mehta | 340/855.7 |
| 8,049,506 | B2 | 11/2011 | Lazarev | 324/333 |
| 8,115,651 | B2 | 2/2012 | Camwell et al. | 340/853.2 |

(56) References Cited

U.S. PATENT DOCUMENTS 8,117,907 B2 2/2012 Han et al. ..... 73/152.58
8,157,008 B2 4/2012 Lilley ..... 166/253.1
8,162,050 B2 4/2012 Roddy et al. ..... 166/253.1
8,220,542 B2 7/2012 Whitsitt et al. ..... 166/278
8,237,585 B2 8/2012 Zimmerman ..... 340/854.6
8,242,928 B2 8/2012 Prammer ..... 340/853.7
8,276,674 B2 10/2012 Lopez de Cardenas et al. ..... 166/373
8,284,075 B2 10/2012 Fincher et al. ..... 340/854.4
8,284,947 B2 10/2012 Giesbrecht et al. ..... 381/66
8,316,936 B2 11/2012 Roddy et al. ..... 166/253.1
8,330,617 B2 12/2012 Chen et al. ..... 340/854.6
8,347,982 B2 1/2013 Hannegan et al. ..... 175/5
8,358,220 B2 1/2013 Savage ..... 340/853.1
8,376,065 B2 2/2013 Teodorescu et al. ..... 175/40
8,381,822 B2 2/2013 Hales et al. ..... 166/377
8,388,899 B2 3/2013 Mitani et al. ..... 422/179
8,411,530 B2 4/2013 Slocum et al. ..... 367/90
8,434,354 B2 5/2013 Crow et al. ..... 73/152.04
8,494,070 B2 7/2013 Luo et al. ..... 375/262
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,552,597 B2 10/2013 Song et al. ..... 307/149
8,556,302 B2 10/2013 Dole ..... 285/367
8,559,272 B2 10/2013 Wang
8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 * 9/2014 Purkis ..... E21B 34/066 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,561 B1 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2003/0056953 A1 3/2003 Tumlin et al. ..... 166/298
2003/0117896 A1 6/2003 Sakuma et al. ..... 367/81
2003/0192692 A1 * 10/2003 Tubel ..... E21B 41/00 166/250.15
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0269083 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2007/0024464 A1 * 2/2007 Lemenager ..... E21B 47/122 340/853.1
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0247329 A1 * 10/2007 Petrovic ..... G01V 11/002 340/854.4
2007/0272411 A1 11/2007 Lopez de Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 * 8/2008 Lovell ..... E21B 33/1208 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 * 4/2010 Rioufol ..... E21B 43/12 73/152.28
2010/0133004 A1 6/2010 Burleson et al. ..... 175/2
2010/0182161 A1 7/2010 Robbins et al. ..... 340/853.7
2010/0212891 A1 * 8/2010 Stewart ..... E21B 23/00 166/250.12
2011/0061862 A1 * 3/2011 Loretz ..... E21B 33/1208 166/250.11
2011/0066378 A1 3/2011 Lerche et al. ..... 702/6
2011/0168403 A1 * 7/2011 Patel ..... E21B 23/065 166/373
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 * 12/2011 Rioufol ..... E21B 47/01 166/250.17
2012/0043079 A1 2/2012 Wassouf et al. ..... 166/250
2012/0055669 A1 * 3/2012 Levin ..... E21B 33/1208 166/250.17
2012/0126992 A1 5/2012 Rodney et al. ..... 340/850
2012/0152562 A1 6/2012 Newton et al. ..... 166/369
2012/0179377 A1 7/2012 Lie ..... 702/6
2013/0000981 A1 1/2013 Grimmer et al. ..... 175/45
2013/0003503 A1 1/2013 L'Her et al. ..... 367/106

(56) References Cited

U.S. PATENT DOCUMENTS

| | | | | |
|---|---|---|---|---|
| 2013/0106615 | A1 | 5/2013 | Prammer | 340/854.6 |
| 2013/0138254 | A1 | 5/2013 | Seals et al. | 700/282 |
| 2013/0192823 | A1 | 8/2013 | Barrilleaux et al. | 166/250.01 |
| 2013/0248172 | A1* | 9/2013 | Angeles Boza | E21B 43/08 166/250.01 |
| 2013/0278432 | A1* | 10/2013 | Shashoua | G01V 3/18 340/853.7 |
| 2013/0319102 | A1 | 12/2013 | Ringgenberg et al. | 73/152.28 |
| 2014/0060840 | A1 | 3/2014 | Hartshorne et al. | 166/300 |
| 2014/0062715 | A1 | 3/2014 | Clark | 340/853.2 |
| 2014/0102708 | A1 | 4/2014 | Purkis et al. | 166/308.1 |
| 2014/0133276 | A1 | 5/2014 | Volker et al. | 367/82 |
| 2014/0152659 | A1 | 6/2014 | Davidson et al. | 345/420 |
| 2014/0153368 | A1 | 6/2014 | Bar-Cohen et al. | 367/81 |
| 2014/0166266 | A1 | 6/2014 | Read | 166/250.01 |
| 2014/0170025 | A1 | 6/2014 | Weiner et al. | 422/82.01 |
| 2014/0266769 | A1 | 9/2014 | van Zelm | 340/854.3 |
| 2014/0327552 | A1 | 11/2014 | Filas et al. | 340/854.6 |
| 2014/0352955 | A1 | 12/2014 | Tubel et al. | 166/250.15 |
| 2015/0003202 | A1 | 1/2015 | Palmer et al. | 367/82 |
| 2015/0009040 | A1 | 1/2015 | Bowles et al. | 340/854.6 |
| 2015/0027687 | A1 | 1/2015 | Tubel | 166/72 |
| 2015/0041124 | A1* | 2/2015 | Rodriguez | E21B 23/06 166/255.1 |
| 2015/0041137 | A1* | 2/2015 | Rodriguez | E21B 33/12 166/301 |
| 2015/0075781 | A1* | 3/2015 | Buechler | E21B 33/1208 166/250.01 |
| 2015/0152727 | A1 | 6/2015 | Fripp et al. | E21B 47/14 |
| 2015/0159481 | A1 | 6/2015 | Mebarkia et al. | E21B 47/065 |
| 2015/0167425 | A1 | 6/2015 | Hammer et al. | E21B 34/06 |
| 2015/0176370 | A1 | 6/2015 | Greening et al. | E21B 41/00 |
| 2015/0247373 | A1* | 9/2015 | Ross | E21B 23/00 166/387 |
| 2015/0292319 | A1* | 10/2015 | Disko | E21B 47/14 367/82 |
| 2015/0292320 | A1 | 10/2015 | Lynk et al. | E21B 47/16 |
| 2015/0300159 | A1 | 10/2015 | Stiles et al. | E21B 47/16 |
| 2015/0330200 | A1 | 11/2015 | Richard et al. | E21B 44/00 |
| 2015/0337642 | A1 | 11/2015 | Spacek | E21B 44/005 |
| 2015/0354351 | A1 | 12/2015 | Morrow et al. | E21B 47/16 |
| 2015/0377016 | A1 | 12/2015 | Ahmad | E21B 47/122 |
| 2016/0010446 | A1 | 1/2016 | Logan et al. | E21B 47/122 |
| 2016/0047230 | A1* | 2/2016 | Livescu | C09K 8/80 166/250.01 |
| 2016/0047233 | A1 | 2/2016 | Butner et al. | E21B 47/12 |
| 2016/0076363 | A1 | 3/2016 | Morrow et al. | E21B 47/12 |
| 2016/0084077 | A1* | 3/2016 | Lehr | E21B 21/103 367/83 |
| 2016/0109606 | A1 | 4/2016 | Market et al. | G01V 1/50 |
| 2016/0208605 | A1* | 7/2016 | Morrow | E21B 43/122 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0145819 | A1* | 5/2017 | Maida, Jr. | E21B 47/12 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2017/0321544 | A1* | 11/2017 | Wilson | E21B 43/20 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |
| 2019/0128080 | A1* | 5/2019 | Ross | E21B 27/02 |

FOREIGN PATENT DOCUMENTS

| | | | | |
|---|---|---|---|---|
| EP | 1409839 | | 4/2005 | E21B 43/1185 |
| EP | 2677698 | | 12/2013 | H04L 12/28 |
| WO | WO2002/027139 | | 4/2002 | E21B 43/12 |
| WO | WO2010/074766 | | 7/2010 | A41C 1/14 |
| WO | WO2013/079928 | | 6/2013 | E21B 47/12 |
| WO | WO 2013/079928 | A2 | 6/2013 | |
| WO | WO 2013/112273 | A2 | 8/2013 | |
| WO | WO2014/018010 | | 1/2014 | E21B 47/12 |
| WO | WO 2014/018010 | A1 | 1/2014 | |
| WO | WO2014/049360 | | 4/2014 | E21B 47/12 |
| WO | WO 2014/049360 | A2 | 4/2014 | |
| WO | WO 2014/100264 | A1 | 6/2014 | |
| WO | WO2014/100271 | | 6/2014 | E21B 47/12 |
| WO | WO 2014/100271 | A1 | 6/2014 | |
| WO | WO 2014/100276 | A1 | 6/2014 | |
| WO | WO2014/134741 | | 9/2014 | E21B 47/13 |
| WO | WO 2014/134741 | A1 | 9/2014 | |
| WO | WO2015/117060 | | 8/2015 | E21B 47/12 |
| WO | WO-2017058256 | A1 * | 4/2017 | E21B 34/14 |

OTHER PUBLICATIONS

U.S. Appl. No. 16/139,373, filed Sep. 24, 2018, Yi, Xiaohua et al.
U.S. Appl. No. 16/139,384, filed Oct. 13, 2017, Disko, Mark M. et al.
U.S. Appl. No. 16/139,394, filed Oct. 13, 2017, Song, Limin et al.
U.S. Appl. No. 16/139,403, filed Oct. 13, 2017, Song, Limin et al.
U.S. Appl. No. 16/139,414, filed Oct. 13, 2017, Zhang, Yibing et al.
U.S. Appl. No. 16/139,421, filed Oct. 13, 2017, Song, Limin et al.
U.S. Appl. No. 16/139,427, filed Oct. 13, 2017, Disko, Mark M. et al.
U.S. Appl. No. 16/175,418, filed Oct. 30, 2018, Kent, David K. et al.
U.S. Appl. No. 62/588,067, filed Nov. 17, 2017, Song, Limin et al.
U.S. Appl. No. 62/588,080, filed Nov. 17, 2017, Kinn, Timothy F. et al.
U.S. Appl. No. 62/588,103, filed Nov. 17, 2017, Yi, Xiaohua et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.
Arroyo, Javier et al. (2011) "Forecasting with Interval and Histogram Data Some Financial Applications," *Univ. of California, Dept. of Economics*, 46 pages.
Emerson Process Management (2011), "Roxar downhole Wireless PT sensor system," www.roxar.com, or downhole@roxar.com, 2 pgs.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data in the Indirect Dimension", pp. 8888-8909.
U.S. Department of Defense (1999) "Interoperability and Performance Standards for Medium and High Frequency Radio Systems," MIL-STD-188-141B, Mar. 1, 1999, 584 pages.

* cited by examiner

ZONAL ISOLATION DEVICES INCLUDING SENSING AND WIRELESS TELEMETRY AND METHODS OF UTILIZING THE SAME

CROSS REFERENCE TO RELATED APPLICATION

This application claims the benefit of U.S. Provisional Application Ser. No. 62/381,335 filed Aug. 30, 2016, entitled "Zonal Isolation Devices Including Sensing and Wireless Telemetry and Methods of Utilizing the Same," U.S. Provisional Application Ser. No. 62/381,330 filed Aug. 30, 2016, entitled "Communication Networks, Relay Nodes for Communication Networks, and Methods of Transmitting Data Among a Plurality of Relay Nodes," U.S. Provisional Application Ser. No. 62/428,367, filed Nov. 30, 2016, entitled "Dual Transducer Communications Node for Downhole Acoustic Wireless Networks and Method Employing Same," U.S. Provisional Application Ser. No. 62/428,374, filed Nov. 30, 2016, entitled "Hybrid Downhole Acoustic Wireless Network," U.S. Provisional Application Ser. No. 62/428,385, filed Nov. 30, 2016 entitled "Methods of Acoustically Communicating And Wells That Utilize The Methods," and U.S. Provisional Application Ser. No. 62/433,491, filed Dec. 13, 2016 entitled "Methods of Acoustically Communicating And Wells That Utilize The Methods," the disclosures of which are incorporated herein by reference in their entireties.

FIELD OF THE DISCLOSURE

The present disclosure relates generally to zonal isolation devices that include sensing and wireless telemetry, as well as to methods of utilizing the zonal isolation devices.

BACKGROUND OF THE DISCLOSURE

Hydrocarbon wells often utilize one or more zonal isolation devices. These zonal isolation devices, which may include bridge plugs and/or swellable packers, may be utilized to restrict fluid flow within a fluid conduit of the hydrocarbon well. As an example, in a well that includes distinct oil-producing and water-producing intervals, a swellable packer may be utilized to restrict production of water from the water-producing intervals. As another example, bridge plugs may be utilized to temporarily, or even permanently, isolate a section, or region, of the fluid conduit. The fluid conduit may be defined solely by a wellbore of the hydrocarbon well, may be defined solely by a downhole tubular that extends within the wellbore, and/or may be defined within an annular space that extends between the wellbore and the downhole tubular. Thus, zonal isolation devices may be in contact with, or may be configured to seal against, the wellbore and/or the downhole tubular.

In certain circumstances, it may be desirable to monitor and/or quantify a quality of isolation that is provided by a given zonal isolation device, to monitor one or more properties of the well in a region that is proximal to the zonal isolation device, and/or to selectively permit fluid flow past the zonal isolation device. Each of these activities generally requires wireline and/or coiled tubing workovers, and such workovers are costly and time-intensive. Thus, there exists a need for improved zonal isolation devices including sensing and wireless telemetry, as well as for methods of utilizing the zonal isolation devices.

SUMMARY OF THE DISCLOSURE

Zonal isolation devices including sensing and wireless telemetry and methods of utilizing the same are disclosed herein. The zonal isolation devices include an isolation body, a sensor, and a wireless telemetry device. The isolation body is configured to transition from a contracted conformation to an expanded conformation. In the contracted conformation, a characteristic dimension of the isolation body is less than a characteristic dimension of a fluid conduit of the well such that the zonal isolation device is free to move within the fluid conduit. In the expanded conformation, the characteristic dimension of the isolation body is increased such that the isolation body, and thus the zonal isolation device, is positionally fixed within the fluid conduit and restricts fluid flow of a wellbore fluid within the fluid conduit. The sensor is configured to detect at least one property of the well. The wireless telemetry device is operatively attached to both the isolation body and to the sensor when the isolation body is in both the contracted conformation and the expanded conformation. The wireless telemetry device is configured to transmit a wireless output signal to a wireless data transmission network, and the wireless output signal is indicative of the at least one property of the well.

The zonal isolation devices may be incorporated into a hydrocarbon well that also includes a wellbore and the wireless data transmission network. The wellbore extends between a surface region and a subterranean formation. The wireless data transmission network includes a plurality of relay nodes spaced-apart along a length of the wellbore.

The methods include methods of conveying a wireless signal within a well that includes a wellbore that extends within a subterranean formation. The methods include detecting a property of the well with a sensor of a zonal isolation device. The methods also include transmitting a wireless output signal, which is indicative of the property of the well, with a wireless telemetry device of the zonal isolation device. The methods further include conveying the wireless output signal along a length of the wellbore. The methods also include receiving the wireless output signal with a relay node receiver of a relay node that is positioned within the fluid conduit and spaced-apart from the zonal isolation device along the length of the wellbore.

DETAILED DESCRIPTION AND BEST MODE OF THE DISCLOSURE

Figure 1:
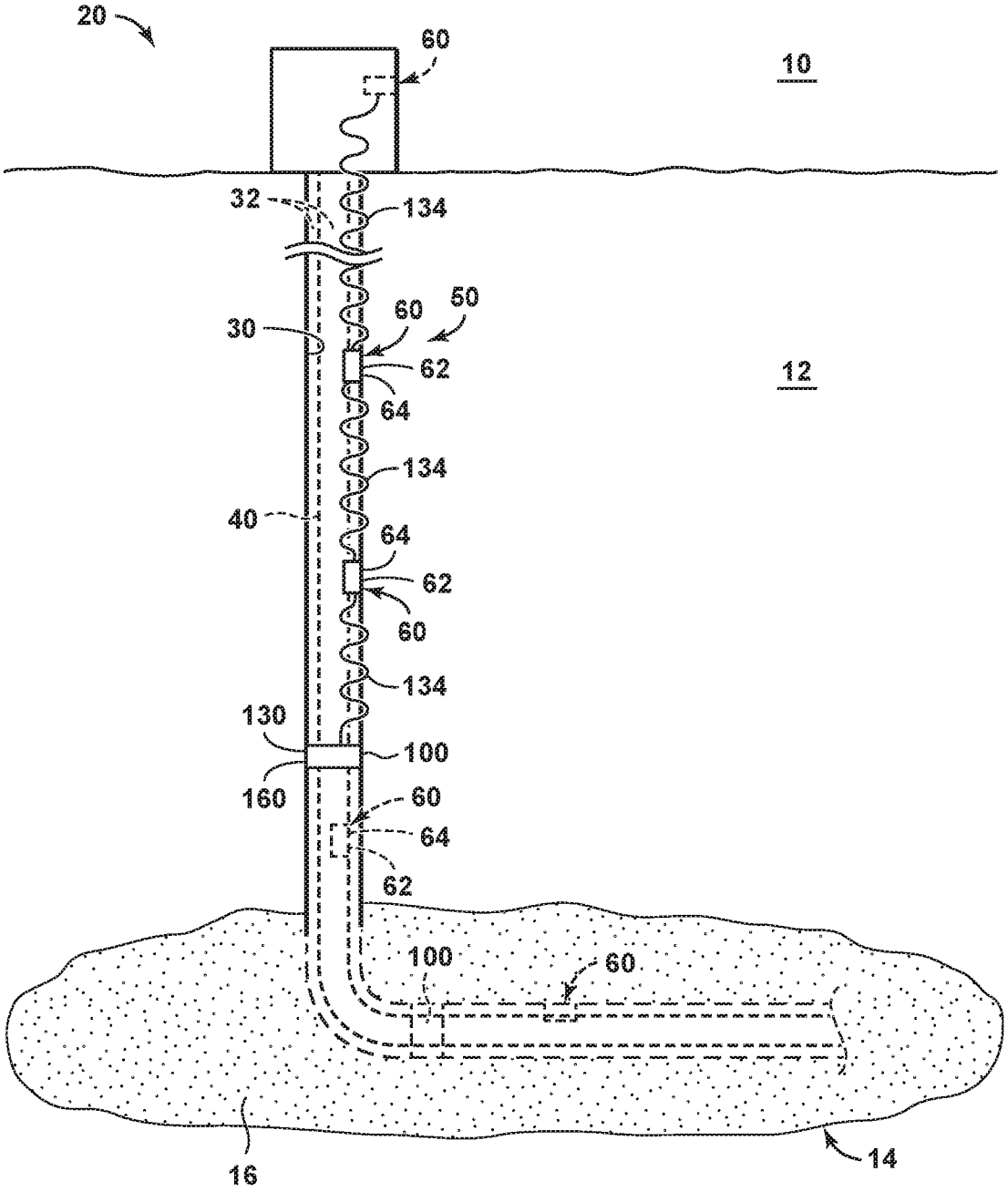
FIG. 1 is a schematic representation of hydrocarbon wells that may include zonal isolation devices according to the present disclosure.

FIGS. 1-7 provide examples of zonal isolation devices 100, of hydrocarbon wells 20 that include zonal isolation devices 100, and/or of methods 200, according to the present disclosure. Elements that serve a similar, or at least substantially similar, purpose are labeled with like numbers in each of FIGS. 1-7, and these elements may not be discussed in detail herein with reference to each of FIGS. 1-7. Similarly, all elements may not be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation of hydrocarbon wells 20 that may include zonal isolation devices 100 according to the present disclosure. As illustrated in solid lines in FIG. 1, hydrocarbon wells 20 include a wellbore 30 that extends within a subterranean formation 14 that may include hydrocarbons 16. Subterranean formation 14 may be present within a subsurface region 12, and wellbore 30 additionally or alternatively may be referred to herein as extending between a surface region 10 and subterranean formation 14.

Hydrocarbon wells 20 also include a wireless data transmission network 50 including a plurality of relay nodes 60 spaced-apart along a length of wellbore 30. Hydrocarbon wells 20 further include zonal isolation device 100. As discussed in more detail herein with reference to FIG. 2, zonal isolation device 100 includes a sensor 160, which is configured to detect at least one property of the hydrocarbon well, and a wireless telemetry device 130, which is configured to transmit a wireless output signal 134 to at least one relay node 60 of the wireless data transmission network.

Figure 7:
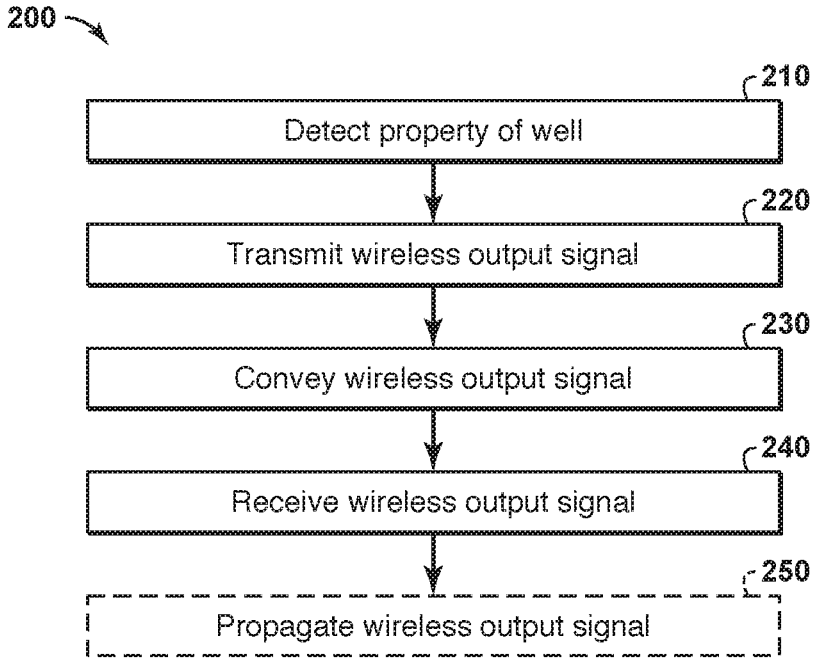
FIG. 7 is a flowchart depicting methods of conveying a wireless signal within a well utilizing zonal isolation devices according to the present disclosure.

During operation of hydrocarbon well 20, and as discussed in more detail herein with reference to methods 200 of FIG. 7, sensor 160 may sense and/or detect the at least one property of the hydrocarbon well. Subsequently, wireless telemetry device 130 may transmit, or generate, the wireless output signal 134, and the wireless output signal may be indicative of the at least one property of the hydrocarbon well. The wireless output signal then may be conveyed along the length of wellbore 30, via any suitable conveyance medium, to a relay node 60 of wireless data transmission network 50. Relay nodes 60 then may propagate, repeat, and/or relay the wireless output signal along the length of the wellbore and/or to surface region 10.

Stated another way, hydrocarbon wells 20 according to the present disclosure, which include wireless data transmission networks 50 and zonal isolation devices 100, may be configured such that data, such as the at least one property of the hydrocarbon well, that is sensed and/or detected by sensor 160 of zonal isolation device 100 may be wirelessly conveyed along the length of the wellbore in any suitable direction as wireless output signals 134. Such a configuration may permit sensing of the at least one property of the hydrocarbon well in a region of the wellbore that is proximal to zonal isolation device 100 without the need to perform costly wireline and/or coiled tubing workovers. Such a configuration additionally or alternatively may permit the at least one property of the hydrocarbon well to be conveyed along the length of the wellbore without utilizing physical and/or wired connections, thereby avoiding fluid leakage pathways that may be present along the length of the physical and/or wired connections.

Wireless data transmission network 50 may include any suitable structure that includes relay nodes 60 and/or that is configured to wirelessly transmit wireless output signal 134 along at least a portion of the length of wellbore 30. This transmission may be accomplished in any suitable manner. As an example, relay nodes 60 may be configured to wirelessly propagate, or relay, the wireless output signal along the length of the wellbore, such as from the zonal isolation device to surface region 10. As a more specific example, a given relay node may receive the wireless output signal and then may transmit the wireless output signal to an adjacent relay node. This process may be repeated any suitable number of times utilizing any suitable number of relay nodes 60 to wirelessly convey the wireless output signal along any suitable portion of the length of the wellbore.

Relay nodes 60 may include any suitable structure. As examples, each relay node 60 may include a relay node transmitter 62, which is configured to produce, generate, and/or transmit wireless output signal 134, and a relay node receiver 64, which is configured to receive the wireless output signal.

It is within the scope of the present disclosure that relay nodes 60 may wirelessly propagate, or convey, wireless output signal 134 via any suitable mechanism and/or utilizing any suitable conveyance medium. Examples of the wireless output signal include one or more of an electromagnetic signal, a fluid pressure pulse within a wellbore fluid that extends within the wellbore, a radio frequency signal, a low frequency radio signal, a mechanical wave, a vibration, and/or an acoustic signal. Examples of the conveyance medium are discussed herein.

It is within the scope of the present disclosure that wellbore 30 may include and/or be any suitable wellbore that extends within subterranean formation 14. As an example, and as illustrated in solid lines in FIG. 1, wellbore 30 may include a vertical, or at least substantially vertical, portion and/or region. As another example, and as illustrated in dashed lines in FIG. 1, wellbore 30 additionally or alternatively may include a deviated and/or horizontal portion and/or region. As further illustrated in FIG. 1, zonal isolation devices 100 and/or relay nodes 60 may be positioned within any suitable portion and/or region of the wellbore, including vertical, deviated, and/or horizontal portions and/or regions of the wellbore.

As illustrated in dashed lines in FIG. 1, a downhole tubular 40 may extend within wellbore 30. The downhole tubular may be defined by a tubular body, and examples of the downhole tubular include a casing string and/or production tubing. Under these conditions, hydrocarbon well 20 may be referred to herein as including a fluid conduit 32 that is defined by, or internal to, downhole tubular 40, and the fluid conduit also may be referred to herein as a tubular conduit 32. Additionally or alternatively, hydrocarbon well 20 also may be referred to as including a fluid conduit 32 that is defined between downhole tubular 40 and wellbore 30, and such a fluid conduit also may be referred to herein as, or may be, an annular space 32 and/or an annular fluid conduit 32.

Additionally or alternatively, it is within the scope of the present disclosure that hydrocarbon well 20 may be an open-hole completion hydrocarbon well that does not include downhole tubular 40 and/or that downhole tubular 40 may not extend along an entirety of a length of the wellbore. Under these conditions, wellbore 30 may be referred to herein as the defining, or as solely defining, fluid conduit 32, and the fluid conduit also may be referred to herein as a wellbore conduit 32.

Zonal isolation devices 100 also may be referred to herein as zonal control devices and may include any suitable structure that includes wireless telemetry device 130 and sensor 160. More specific and/or detailed examples of zonal isolation devices 100 are illustrated in FIGS. 2-6 and discussed in more detail herein with reference thereto. It is within the scope of the present disclosure that any of the structures, functions, and/or features of zonal isolation devices 100 of FIGS. 2-6 may be included in and/or utilized with hydrocarbon wells 20 of FIG. 1. Similarly, any of the structures, functions, and/or features of hydrocarbon wells 20 and/or zonal isolation devices 100 of FIG. 1 may be utilized with zonal isolation devices 100 of FIGS. 2-6 without departing from the scope of the present disclosure.

Figure 2:
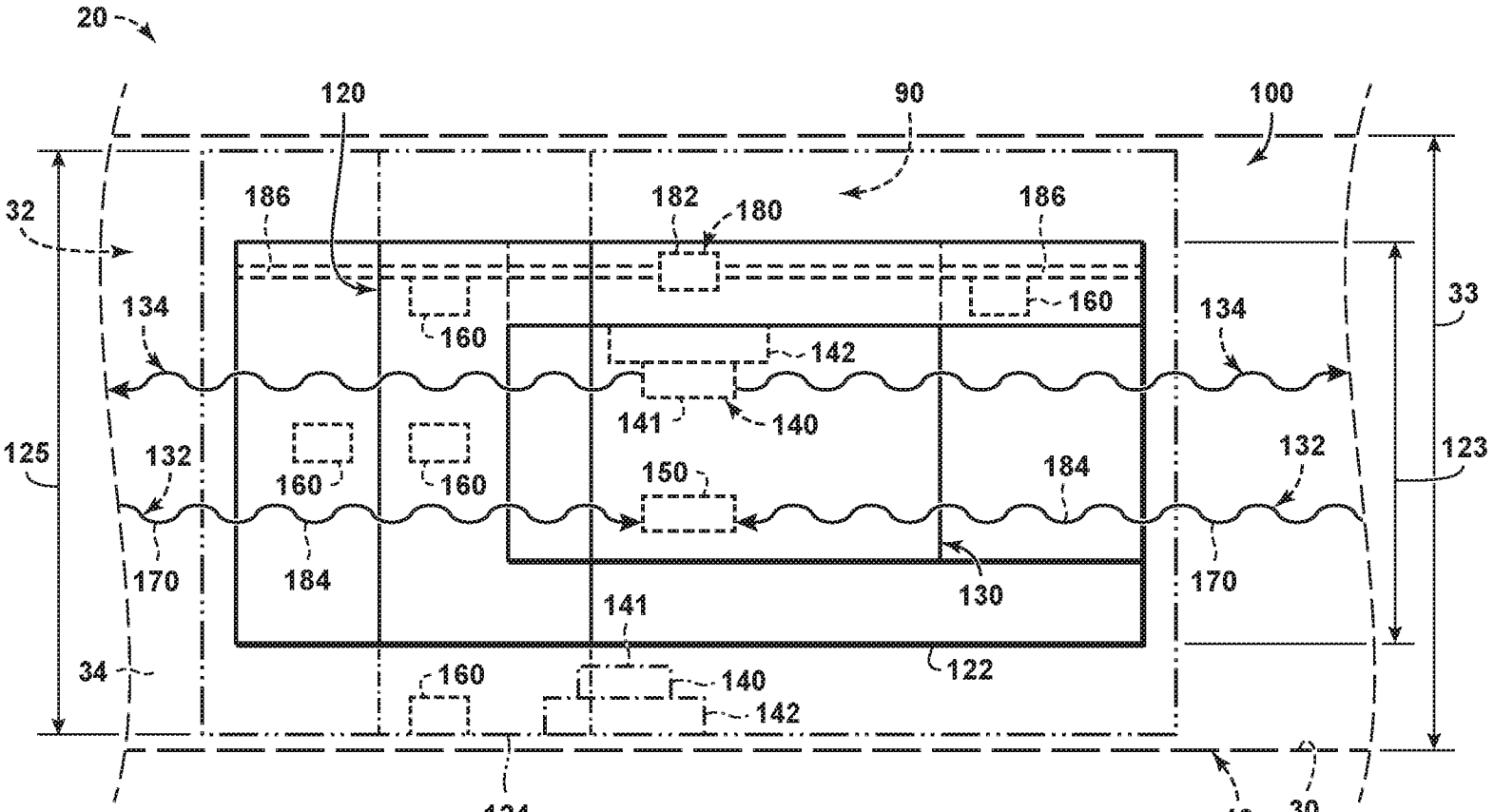
FIG. 2 is a schematic representation of zonal isolation devices according to the present disclosure.

FIG. 2 is a schematic representation of zonal isolation devices 100 according to the present disclosure. FIGS. 3-6 are less schematic cross-sectional views of portions of hydrocarbon wells 20 including zonal isolation devices 100.

As illustrated in FIG. 2, zonal isolation devices 100 include an isolation body 120, at least one sensor 160, and a wireless telemetry device 130. Isolation body 120 is configured to transition from a contracted conformation 122, as illustrated in solid lines in FIG. 2, to an expanded conformation 124, as illustrated in dash-dot and/or in dash-dot-dot lines in FIG. 2. When the isolation body is in contracted conformation 122, a characteristic dimension 123 of the isolation body is less than a characteristic dimension 33 of a fluid conduit 32 of well 20 such that the zonal isolation device is free to move, be pumped, and/or be conveyed within the fluid conduit. In contrast, and when isolation body 120 is in expanded conformation 124, the characteristic dimension 125 is increased, such as to a value that is equal to, or greater than, the characteristic dimension 33 of the fluid conduit, such that the isolation body is positionally fixed, or constrained, within the fluid conduit and/or restricts fluid flow of a wellbore fluid 34 within the fluid conduit. Isolation body 120, sensor 160, and wireless telemetry device 130 are operatively attached and/or affixed to one another to form and/or define zonal isolation device 100 while the zonal isolation device is in both contracted conformation 122 and expanded conformation 124.

When zonal isolation device 100 is utilized within hydrocarbon wells 20, the zonal isolation device initially may be introduced into and/or positioned within fluid conduit 32 while in contracted conformation 122 and may be moved, flowed, and/or conveyed to a desired, or target, location within the fluid conduit. Subsequently, the zonal isolation device may be transitioned to expanded conformation 124 such that the zonal isolation device is retained within the desired, or target, location within the fluid conduit. When in expanded conformation 124, the zonal isolation device may restrict, limit, or even block flow of wellbore fluid 34 therepast and within fluid conduit 32. This may include stopping fluid flow such that no wellbore fluid flows past the zonal isolation device. As another example, this may include restricting, but not necessarily stopping, flow of the wellbore fluid past the zonal isolation device.

When zonal isolation device 100 is positioned within fluid conduit 32, and whether the zonal isolation device is in contracted conformation 122 or expanded conformation 124, sensor 160 may be utilized to sense and/or detect at least one property of well 20, as discussed in more detail herein. In addition, wireless telemetry device 130 may transmit a wireless output signal 134 to a wireless data transmission network 50 that extends within a wellbore 30 of the hydrocarbon well, as illustrated in FIG. 1. This wireless output signal may be based upon, or may be indicative of, the at least one property of the well that is measured by sensor 160 and may be conveyed to a surface region 10 by the wireless data transmission network, as discussed herein with reference to FIG. 1.

Figure 3:
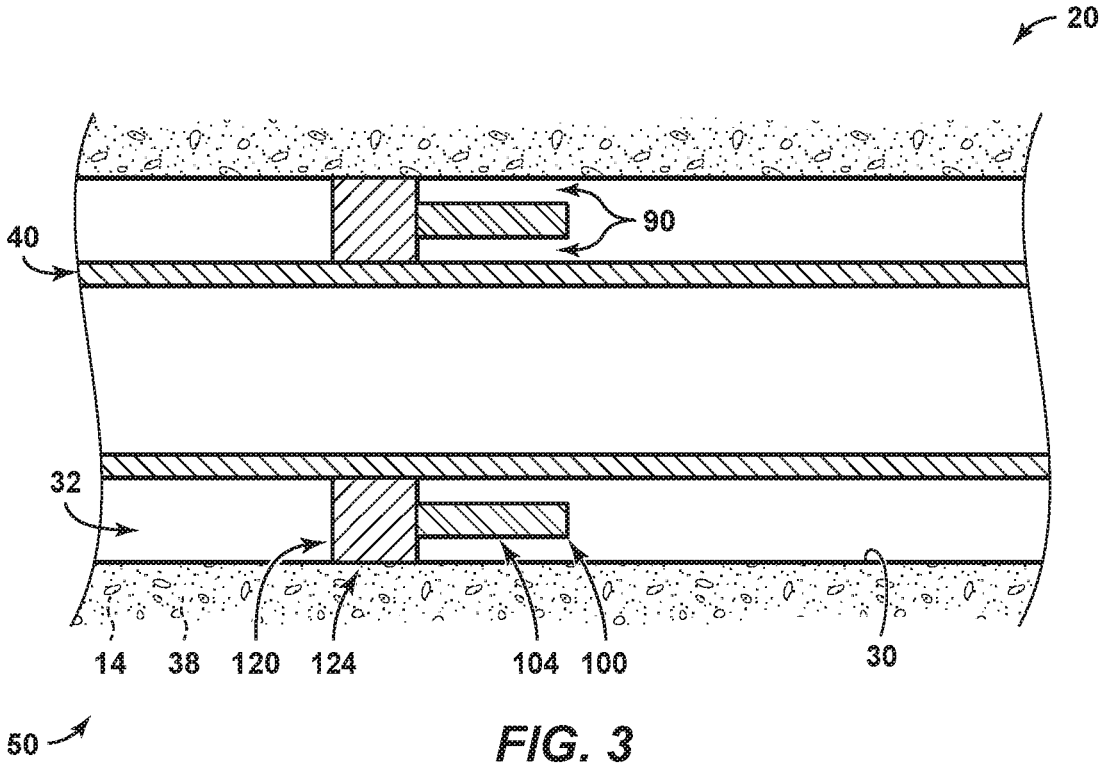
FIG. 3 is a schematic cross-sectional view of a portion of a hydrocarbon well including a zonal isolation device according to the present disclosure.

It is within the scope of the present disclosure that zonal isolation device 100 may include and/or be any suitable zonal isolation device that may be adapted, configured, designed, and/or constructed to restrict fluid flow within any suitable fluid conduit 32 that may be present and/or defined within hydrocarbon well 20. As an example, and as illustrated in FIG. 3, zonal isolation device 100 may be an annular swellable packer 104 that may be positioned within an annular space, or an annular fluid conduit 32, that is at least partially defined between a downhole tubular 40 and a wellbore 30. Under these conditions, the zonal isolation device may be referred to herein as being in direct physical contact, or in sealing contact, with both downhole tubular 40 and wellbore 30. As also illustrated in FIG. 3, zonal isolation device 100 and wellbore 30 and/or downhole tubular 40 may define a gap 90 therebetween, and the zonal isolation device may be configured to transmit the wireless output signal across the gap, as discussed in more detail herein. However, this is not required to all zonal isolation devices 100, and zonal isolation device 100 additionally or alternatively may transmit the wireless output signal via direct contact with wellbore 30 and/or with downhole tubular 40.

Figure 5:
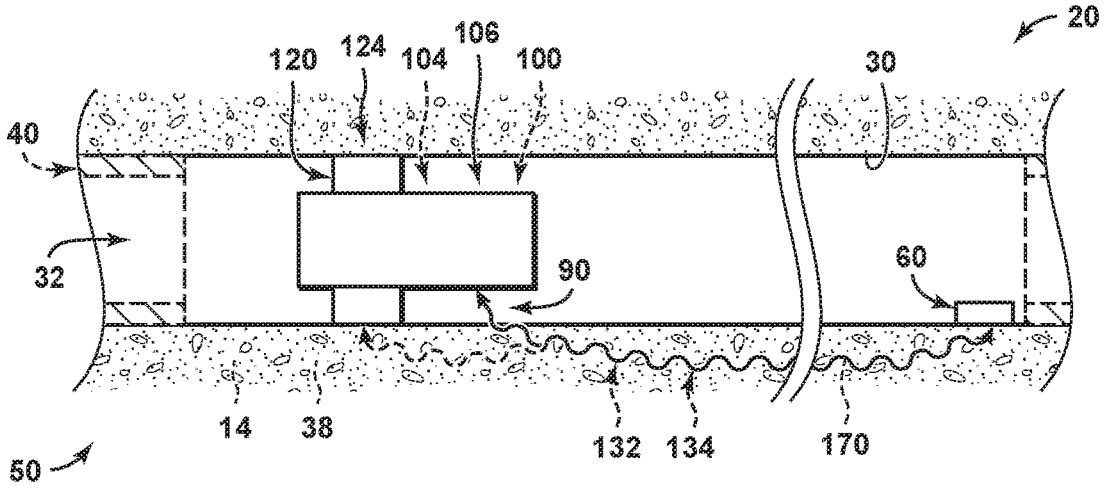
FIG. 5 is a schematic cross-sectional view of a portion of a hydrocarbon well including a zonal isolation device according to the present disclosure.

As another example, and as illustrated in FIG. 5, zonal isolation device 100 may be a swellable packer 104 or a bridge plug 106 that may be positioned within a wellbore conduit 32 that is defined, or fully defined, by wellbore 30. Under these conditions, the zonal isolation device may be referred to herein as being in direct physical contact, or in sealing contact, with wellbore 30 and/or solely with wellbore 30. As also illustrated in FIG. 5, zonal isolation device 100 and wellbore 30 may define a gap 90 therebetween, and the zonal isolation device may be configured to transmit wireless output signal 134 across the gap. However, this too is not required to all zonal isolation devices 100, and zonal isolation device 100 additionally or alternatively may transmit the wireless output signal via direct contact with wellbore 30, as illustrated in dashed lines in FIG. 5.

Figure 6:
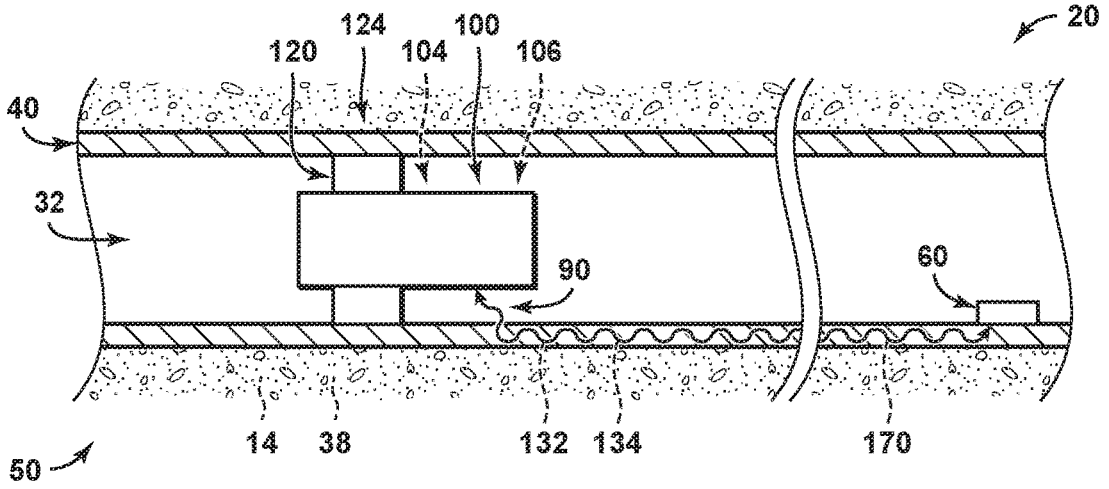
FIG. 6 is a schematic cross-sectional view of a portion of a hydrocarbon well including a zonal isolation device according to the present disclosure.

As yet another example, and as illustrated in FIG. 6, zonal isolation device 100 may be a swellable packer 104 or a bridge plug 106 that may be positioned within a wellbore conduit 32 that is defined, or fully defined, by a downhole tubular 40. Under these conditions, the zonal isolation device may be referred to herein as being in direct physical contact, or in sealing contact, with downhole tubular 40 and/or solely with downhole tubular 40. As also illustrated in FIG. 6, zonal isolation device 100 and downhole tubular 40 may define a gap 90 therebetween, and the zonal isolation device may be configured to transmit wireless output signal 134 across the gap. However, this also is not required to all zonal isolation devices 100, and zonal isolation device 100 additionally or alternatively may transmit the wireless output signal via direct contact with downhole tubular 40, as illustrated in dashed lines in FIG. 6.

In the above examples, wellbore 30 may be defined within any suitable structure. As an example, wellbore 30 may be defined within a subterranean formation 14. As another example, wellbore 30 may be defined within cement 38, which may be positioned within the subterranean formation. When fluid conduit 32 is defined, or fully defined, by wellbore 30, subterranean formation 14 and/or cement 38 may be referred to herein as the tubular body that defines the fluid conduit.

Returning to FIG. 2, sensor 160 may include any suitable structure that may be adapted, configured, designed, and/or constructed to sense and/or detect the at least one property of the well. In addition, sensor 160 may be incorporated into zonal isolation device 100 in any suitable manner. As an example, sensor 160 may be operatively attached to, or directly and operatively attached to, zonal isolation device 100 and/or isolation body 120 thereof when the isolation body is in both the contracted conformation and in the expanded conformation. As another example, sensor 160 may be encapsulated within, or sealed within, zonal isolation device 100 and/or isolation body 120 thereof, as illustrated in dashed lines in FIG. 2. Under these conditions, the sensor may not contact, or directly contact, wellbore fluid 34. As yet another example, at least a portion of sensor 160 may extend in fluid communication with the wellbore fluid, such as when at least a portion of the sensor is exposed on an external surface of zonal isolation device 100. As another example, at least a portion of sensor 160 may be in direct physical contact with wellbore 30 and/or with downhole tubular 40 when the zonal isolation device is positioned within fluid conduit 32 and in expanded conformation 124, as illustrated in dash-dot lines in FIG. 1.

It is within the scope of the present disclosure that sensors 160 may measure and/or detect any suitable property, or properties, of the well. Examples of the property, or properties of the well include a pressure drop across the zonal isolation device, a fluid conductivity between two spaced-apart regions of the subterranean formation, sand motion proximal the zonal isolation device, an acoustic property of the downhole tubular, when present, and/or an acoustic property of the subterranean formation.

Such detected properties may be utilized to determine and/or quantify whether or not fluid containment provided by the zonal isolation device is functioning, or functioning as expected, and/or to determine and/or quantify failure of the zonal isolation device. As examples, detection of the pressure drop across the zonal isolation device, detection of the fluid conductivity between two spaced-apart regions of the subterranean formation, and/or detection of sand motion proximal the zonal isolation device may be utilized to estimate and/or quantify a property that is indicative of a seal integrity of the zonal isolation device, such as by indicating whether or not fluid is flowing past the zonal isolation device within the fluid conduit.

Additionally or alternatively, such detected properties may be utilized by an operator of the hydrocarbon well to determine whether or not it is safe to drill out, or remove, the zonal isolation device and/or to verify that an abandoned well is effectively sealed, such as by the zonal isolation device. As an example, detection of the pressure drop across the zonal isolation device may be utilized to determine whether or not the pressure drop is less than a threshold pressure drop below which it is safe to drill out, or remove, the zonal isolation device.

Additionally or alternatively, such detected properties may be utilized to determine and/or quantify an integrity of wellbore 30 and/or of downhole tubular 40, when present. As an example, the acoustic property of the downhole tubular, or changes in the acoustic property of the downhole tubular as a function of time, may indicate thinning, corrosion, and/or occlusion of the downhole tubular. As another example, the acoustic property of the subterranean formation, or changes in the acoustic property of the subterranean formation as a function of time, may indicate changes in a fluid conductivity of the subterranean formation and/or cracking of the subterranean formation.

It is within the scope of the present disclosure that sensors 160 may be adapted, configured, designed, and/or constructed to determine, detect, and/or quantify any suitable one or more other properties of the well. Examples of the properties of the well include a temperature, a pressure, a vibrational amplitude, a vibrational frequency, a strain within the zonal isolation device, an electrical conductivity of the wellbore fluid, a flow rate of the wellbore fluid, a presence of a multiphase flow within the fluid conduit, a chemical composition of the wellbore fluid, a density of the wellbore fluid, and/or a viscosity of the wellbore fluid.

Similarly, sensors 160 may include any suitable structure that is adapted, configured, designed, and/or constructed to determine, detect, and/or quantify the at least one property of the well. As examples, sensors 160 may include one or more of a temperature sensor, a pressure sensor, a differential pressure sensor, a differential pressure sensor configured to detect a pressure differential between an uphole side of the zonal isolation device and a downhole side of the zonal isolation device, an acoustic sensor, a vibration sensor, an acoustic transmitter, an acoustic receiver, a strain gauge, an electrical conductivity sensor, a fluid flow meter, a multiphase flow sensor, a chemical composition sensor, a fluid density sensor, and/or a viscosity sensor.

When sensors 160 include the vibration sensor and/or detect the vibrational amplitude and/or frequency, the sensors may detect any suitable vibration. As examples, the sensors may detect passive, or passively initiated, vibrations, such as vibrations that result from fractures within the subterranean formation, deformation of seals, and/or actuation of valves. Additionally or alternatively, the sensors may detect active vibrations, such as low frequency and/or ultrasound vibrations, or pings, which may be selectively initiated by a vibration source, and/or related vibrations due to reflection and/or scattering of the pings.

Wireless telemetry device 130 may include any suitable structure that may be adapted, configured, designed, constructed, and/or programmed to transmit the wireless output signal to the wireless data transmission network and/or to communicate with one or more relay nodes of the wireless data transmission network. As an example, and as illustrated in FIG. 2, the wireless telemetry device may include a wireless transmitter 140 configured to generate the wireless output signal. As another example, the wireless telemetry device additionally or alternatively may include a wireless receiver 150.

Examples of the wireless transmitter include an electromagnetic transmitter, an acoustic transmitter, and/or a radio frequency transmitter. An example of an acoustic transmitter includes a piezoelectric transmitter element 141, which may be configured to vibrate at a data transmission frequency to produce and/or generate the wireless output signal in the form of an acoustic wireless output signal. When wireless transmitter 140 includes, or is, the acoustic transmitter, the acoustic transmitter further may include a rigid plate 142, which may be operatively linked to the piezoelectric transmitter element and/or may be configured to vibrate with the piezoelectric transmitter element. Examples of rigid plate 142 include a metallic plate, a steel plate, and/or an aluminum plate.

When wireless transmitter 140 includes piezoelectric transmitter element 141 and rigid plate 142, the rigid plate may be in contact, or in direct physical contact, with the piezoelectric transmitter element. Additionally or alternatively, the rigid plate may extend between the piezoelectric transmitter element and wellbore fluid 34 when, or while, the zonal isolation device is positioned within fluid conduit 32.

It is within the scope of the present disclosure that, when zonal isolation device 100 is positioned within the tubular conduit and in expanded conformation 124, rigid plate 142 may be in contact, or in direct physical contact, with a tubular body that defines fluid conduit 32. This is illustrated in dash-dot lines in FIG. 1. Additionally or alternatively, the rigid plate may be separated from the tubular body by gap 90, as illustrated in dashed lines in FIG. 2. Examples of the tubular body include subterranean formation 14, cement 38, and/or downhole tubular 40, as discussed herein.

Gap 90, when present, may not extend between an entirety of zonal isolation device 100 and an entirety of the tubular body. Instead, and as illustrated, gap 90 extends between a portion, fraction, or region of the zonal isolation device and a portion, fraction, or region of the tubular body. As an example, gap 90 may be an annular gap 90 that is defined between the zonal isolation device and the tubular body. As another example, gap 90 may be defined between an outer surface of the zonal isolation device and an inner surface and/or an outer surface of the tubular body.

Wireless output signal 134 may include, or be, any suitable signal. As examples, the wireless output signal may include one or more of an electromagnetic signal, a fluid pressure pulse within the wellbore fluid, a radio frequency signal, a mechanical wave, a vibration, and/or an acoustic signal.

Figure 4:
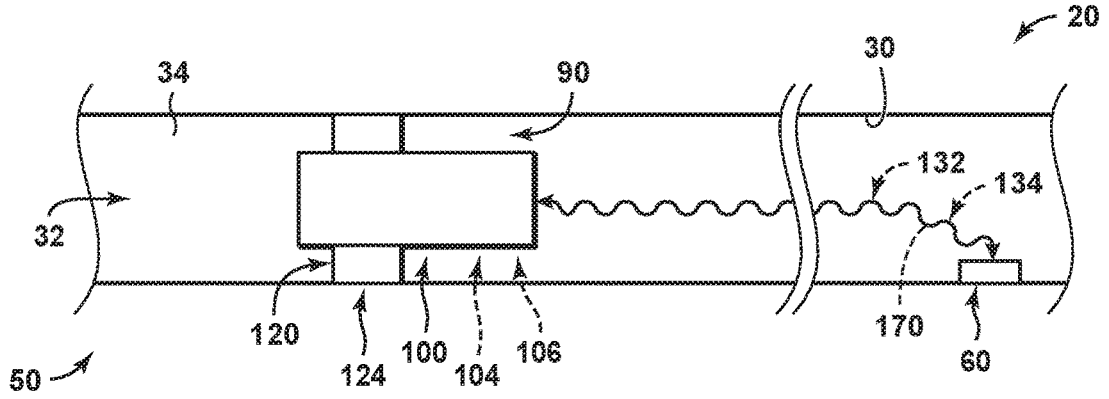
FIG. 4 is a schematic cross-sectional view of a portion of a hydrocarbon well including a zonal isolation device according to the present disclosure.

Furthermore, the wireless telemetry device may be configured to transmit the wireless output signal via, through, and/or utilizing any suitable conveyance, or transmission, medium. In addition, a nature, amplitude, and/or frequency of the wireless output signal may be selected and/or tuned for a specific conveyance medium. As an example, and as illustrated in FIG. 4, the wireless telemetry device may be configured to transmit the wireless output signal via, through, and/or utilizing wellbore fluid 34. As another example, and as illustrated in FIG. 5, the wireless telemetry device may be configured to transmit the wireless output signal via, through, and/or utilizing subterranean formation 14 and/or cement 38 within which fluid conduit 32 may be defined and/or extends. As yet another example, and as illustrated in FIG. 6, the wireless telemetry device may be configured to transmit the wireless output signal via, through, and/or utilizing downhole tubular 40.

It is within the scope of the present disclosure that sensor 160 may measure the at least one property of the well and/or that wireless telemetry device 130 may be programmed to transmit the wireless output signal based upon, or responsive to, any suitable criteria. As examples, the wireless telemetry device may be programmed to transmit, or to initiate transmission of, the wireless output signal responsive to measurement of the at least one property of the well by the sensor, periodically, and/or based upon a predetermined elapsed time interval. As another example, the wireless telemetry device may be programmed to transmit the wireless output signal responsive to receipt of a wireless input signal 132, such as a wireless data query 170, which may be transmitted to the zonal isolation device and/or to wireless receiver 150 thereof from wireless data transmission network 50 and/or a relay node 60 thereof, as illustrated in FIGS. 2 and 4-6.

As yet another example, the wireless telemetry device may be programmed to transmit the wireless output signal responsive to satisfaction of a predetermined data transmission condition. Examples of the predetermined data transmission condition include detection, by the sensor, of less than a lower threshold pressure drop across the zonal isolation device, detection, by the sensor, of greater than an upper threshold pressure drop across the zonal isolation device, detection, by the sensor, of greater than a threshold fluid flow rate past the zonal isolation device, and/or detection, by the sensor, of failure of a seal between the isolation body and a downhole tubular that at least partially defines the fluid conduit.

Wireless receiver 150 may include any suitable structure. As examples, wireless receiver 150 may include, or be, an electromagnetic receiver, an acoustic receiver, a piezoelectric receiver element, and/or a radio frequency receiver.

It is within the scope of the present disclosure that wireless telemetry device 130 additionally or alternatively may be configured to receive wireless input signal 132 and to generate wireless output signal 134 based, at least in part, on the wireless input signal and/or upon receipt of the wireless input signal. As an example, wireless input signal 132 and wireless output signal 134 both may be representative, or indicative, of a propagated data stream that is propagated along a length of fluid conduit 32 by, via, and/or utilizing zonal isolation device 100, as discussed in more detail herein.

Isolation body 120 may include any suitable structure that may be adapted, configured, designed, and/or constructed to transition between contracted conformation 122 and expanded conformation 124. As an example, isolation body 120 may include, or be, an elastomeric body configured to be deformed to transition from the contracted conformation to the expanded conformation. As another example, isolation body 120 may include, or be, a swellable material selected and/or configured to swell, upon contact with the wellbore fluid, to transition from the contracted conformation to the expanded conformation.

It is within the scope of the present disclosure that isolation body 120 may expand in any suitable manner, or direction, upon transitioning from the contracted conformation to the expanded conformation. As an example, and as illustrated in dash-dot lines in FIG. 2, isolation body 120 may expand only, or primarily, outward and/or toward the tubular body that defines fluid conduit 32. As another example, and as illustrated in dash-dot-dot lines in FIG. 2, isolation body 120 may expand in all, or at least substantially all, directions, or even isotropically.

As illustrated in dashed lines in FIG. 2, zonal isolation device 100 may include a wirelessly triggered actuator 180. Under these conditions, wireless telemetry device 130 may be configure to receive wireless input signal 132, in the form of a wireless actuation signal 184, and wirelessly triggered actuator 180 may be configured to transition between an unactuated configuration and an actuated configuration responsive to receipt of the wireless actuation signal.

As a more specific example, wirelessly triggered actuator 180 may include, or be, a wirelessly actuated valve 182 configured to control and/or regulate fluid flow through a pass-through conduit 186. Wirelessly actuated valve 182 may define an open configuration, in which the wirelessly actuated valve permits fluid flow through pass-through conduit 186, and a closed configuration, in which the wirelessly actuated valve restricts fluid flow through the pass-through conduit. The actuated configuration may correspond to the open configuration and the unactuated configuration may correspond to the closed configuration. Under these conditions, wirelessly actuated valve 182 may be configured to selectively transition from the closed configuration to the open configuration, such as to permit wellbore fluid 34 to flow past zonal isolation device 100, responsive to receipt of wireless actuation signal 184. Such a configuration may permit selective pressure equalization across the zonal isolation device while the zonal isolation device is positioned within fluid conduit 32 and in expanded conformation 124.

FIG. 7 is a flowchart depicting methods 200, according to the present disclosure, of conveying a wireless signal within a well, which includes a wellbore that extends within a subterranean formation. Methods 200 include detecting a property of the well at 210, transmitting a wireless output signal at 220, conveying the wireless output signal at 230, and receiving the wireless output signal at 240. Methods 200 further may include propagating the wireless output signal at 250.

Detecting the property of the well at 210 may include detecting any suitable property of the well with and/or utilizing a sensor of a zonal isolation device. This may include detecting the property of the well with and/or utilizing sensor 160 of FIG. 2, and examples of properties of the well that may be detected during the detecting at 210 are disclosed herein with reference to sensor 160 of FIG. 2. Examples of the zonal isolation device are disclosed herein with reference to zonal isolation device 100 of FIGS. 1-6.

Transmitting the wireless output signal at 220 may include transmitting the wireless output signal with a wireless telemetry device of the zonal isolation device. The wireless output signal may be indicative of the property of the well that was detected during the detecting at 210, and the zonal isolation device may be positioned, or even positionally fixed, within a fluid conduit that extends within the wellbore. The transmitting at 220 may include transmitting with and/or utilizing any suitable wireless telemetry device, examples of which are disclosed herein with respect to wireless telemetry device 130 of FIG. 2.

It is within the scope of the present disclosure that the transmitting at 220 may include transmitting any suitable wireless output signal, examples of which are disclosed herein with reference to wireless output signal 134 of FIGS. 1-2 and 4-6. As examples, the transmitting at 220 may include transmitting an acoustic wireless output signal, an electromagnetic wireless output signal, a fluid pressure pulse, and/or a radio frequency output signal.

Conveying the wireless output signal at 230 may include conveying the wireless output signal along, or in a direction that extends along, a length of the wellbore. While not required of all embodiments, it is within the scope of the present disclosure that the conveying at 230 may include conveying an entirety of the wireless output signal via a non-metallic conveyance medium over at least a portion of a transmission distance between the zonal isolation device and a relay node. As an example, and as discussed herein with reference to FIG. 2, isolation body 120 may be formed from a non-metallic material, such as an elastomeric material. Under these conditions, the conveying at 120 may include conveying the wireless output signal from the wireless telemetry device and to the relay node at least partially via and/or through the elastomeric material. This may include conveying the wireless output signal from the wireless telemetry device, through the non-metallic isolation body, into a metallic downhole tubular that defines the fluid conduit, and along the metallic downhole tubular to the relay node.

As another example, and as discussed herein with reference to FIGS. 2-6, a gap 90 may extend between at least a portion of zonal isolation device 100 and at least a portion of a tubular body that defines fluid conduit 32 within which the zonal isolation device is positioned. Under these conditions, the conveying at 230 may include conveying the wireless output signal across the gap. This may include conveying an entirety of the wireless output signal through, or via, the non-metallic conveyance medium, such as wellbore fluid 34, which fills the gap, as illustrated in solid lines in FIGS. 5-6.

As yet another example, the zonal isolation device, or the isolation body thereof, may be in direct physical contact with the wellbore, such as with a subterranean formation and/or with cement that defines the wellbore. Under these conditions, the conveying at 230 may include conveying an entirety of the wireless output signal from the wireless telemetry device and over at least a portion of a distance to the relay node via the wellbore fluid, via the subterranean formation, and/or via the cement.

The conveying at 230 may include conveying any suitable wireless output signal. Examples of the wireless output signal are disclosed herein.

Receiving the wireless output signal at 240 may include receiving the wireless output signal with the relay node, such as relay nodes 60 of FIG. 1. As illustrated therein, the relay node may be positioned within the fluid conduit and/or may be spaced-apart from the zonal isolation device along the length of the wellbore. The receiving at 240 may include receiving any suitable wireless output signal, examples of which are disclosed herein.

Propagating the wireless output signal at 250 may include propagating, relaying, and/or repeating the wireless output signal along the length of the fluid conduit. As an example, the relay node may be a first relay node in a wireless data transmission network that includes a plurality of spaced-apart relay nodes. Under these conditions, the propagating at 250 may include propagating the wireless output signal from the zonal isolation device, along the length of the fluid conduit, and/or to a surface region via and/or utilizing at least a portion of the plurality of spaced-apart relay nodes. This may include transmitting the wireless output signal from the first relay node, receiving the wireless output signal with a second relay node, transmitting the wireless output signal from the second relay node, and/or receiving the wireless output signal with a third relay node. This process may be repeated any suitable number of times utilizing any suitable number of relay nodes.

It is within the scope of the present disclosure that zonal isolation devices 100, hydrocarbon wells 20, and/or methods 200 disclosed herein may be modified in any suitable manner. Additionally or alternatively, it is also within the scope of the present disclosure that one or more structures, components, and/or features of zonal isolation devices 100 and/or methods 200 disclosed herein may be utilized with one or more other structures, components, and/or features of a hydrocarbon well, such as hydrocarbon well 20 of FIG. 1.

As an example, the zonal isolation device instead may be another, or a different, downhole structure that may be configured for wireless communication within a fluid conduit. Under these conditions, the other downhole structure may include wireless telemetry device 130 and sensor 160 but is not necessarily required to include isolation body 120 and may be positionally fixed within the fluid conduit in any suitable manner. As an example, the other downhole structure may include a spike, which may be driven into the tubular body that defines the fluid conduit. Such a downhole structure may be referred to herein as a data node and/or as a downhole data node.

As another example, the other downhole structure may include, or be, a zonal control device configured to regulate, but not necessarily to block, fluid flow within the hydrocarbon well. An example of such a zonal control device is an inflow restriction. Such a zonal control device still may include wireless telemetry device 130 and sensor 160 and may be positionally fixed within the fluid conduit via a threaded connection, via a fastener, and/or via a weld. As an example, such a zonal control device may be installed within a downhole tubular, such as a casting string or production tubing, prior to the downhole tubular being positioned within the wellbore.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil, gas, and well drilling industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A zonal isolation device configured to be placed within a fluid conduit of a well with a wireless data transmission network, the zonal isolation device comprising:

an isolation body configured to transition from a contracted conformation, in which a characteristic dimension of the isolation body is less than a characteristic dimension of the fluid conduit of the well such that the zonal isolation device is free to move within the fluid conduit, and an expanded conformation, in which the characteristic dimension of the isolation body is increased such that the isolation body is positionally fixed within the fluid conduit and restricts fluid flow of a wellbore fluid within the fluid conduit;

a sensor configured to detect at least one property of the well, wherein at least a portion of the sensor is in direct physical contact with a downhole tubular that defines at least a portion of the fluid conduit when the zonal isolation device is positioned within the fluid conduit and in the expanded conformation; and a wireless telemetry device configured to transmit a wireless output signal to the wireless data transmission network, wherein the wireless output signal is an acoustic signal, wherein the wireless telemetry device is operatively attached to the isolation body when the isolation body is in both the contracted conformation and the expanded conformation, and further, wherein the wireless output signal is indicative of the at least one property of the well.

2. The zonal isolation device of claim 1, wherein the sensor is operatively attached to the isolation body when the isolation body is in both the contracted conformation and the expanded conformation.

3. The zonal isolation device of claim 1, wherein the at least one property of the well includes at least one of:

(i) a property indicative of a seal integrity of the zonal isolation device within the fluid conduit;
(ii) a property indicative of an integrity of the downhole tubular that at least partially defines the fluid conduit;
(iii) a temperature;
(iv) a pressure;
(v) a vibrational amplitude;
(vi) a vibrational frequency;
(vii) a strain within the zonal isolation device;
(viii) an electrical conductivity of the wellbore fluid;
(ix) a flow rate of the wellbore fluid;
(x) a presence of a multiphase flow within the fluid conduit;
(xi) a chemical composition of the wellbore fluid;
(xii) a density of the wellbore fluid; and
(xiii) a viscosity of the wellbore fluid.

4. The zonal isolation device of claim 1, wherein the sensor includes at least one of:

(i) a pressure sensor;
(ii) a differential pressure sensor configured to detect a pressure differential between an uphole side of the zonal isolation device and a downhole side of the zonal isolation device;
(iii) an acoustic sensor;
(iv) a vibration sensor;
(v) an acoustic transmitter;
(vi) an acoustic receiver;
(vii) a temperature sensor;
(viii) a strain gauge;
(ix) an electrical conductivity sensor;
(x) a fluid flow meter;
(xi) a multiphase flow sensor;
(xii) a chemical composition sensor;
(xiii) a fluid density sensor; and
(xiv) a viscosity sensor.

5. The zonal isolation device of claim 1, wherein the wireless telemetry device is configured to transmit an entirety of the wireless output signal via a non-metallic conveyance medium and across a gap that extends between the wireless telemetry device and the downhole tubular.

6. The zonal isolation device of claim 1, wherein the wireless telemetry device is programmed to transmit the wireless output signal responsive to satisfaction of a predetermined data transmission condition, and further wherein the predetermined data transmission condition includes at least one of:

(i) detection, by the sensor, of less than a lower threshold pressure drop across the zonal isolation device;
(ii) detection, by the sensor, of greater than an upper threshold pressure drop across the zonal isolation device;
(iii) detection, by the sensor, of greater than a threshold fluid flow rate past the zonal isolation device; and
(iv) detection, by the sensor, of failure of a seal between the isolation body and the downhole tubular that at least partially defines the fluid conduit.

7. The zonal isolation device of claim 1, wherein the wireless telemetry device includes a wireless transmitter configured to generate the wireless output signal.

8. The zonal isolation device of claim 7, wherein the wireless transmitter includes at least one of:

(i) an electromagnetic transmitter; and
(ii) a radio frequency transmitter.

9. The zonal isolation device of claim 7, wherein the wireless transmitter includes an acoustic transmitter.

10. The zonal isolation device of claim 9, wherein the acoustic transmitter includes a piezoelectric transmitter element configured to vibrate at a data transmission frequency to generate the wireless output signal.

11. The zonal isolation device of claim 10, wherein the acoustic transmitter further includes a rigid plate operatively linked to the piezoelectric transmitter element and configured to vibrate with the piezoelectric transmitter element.

12. The zonal isolation device of claim 11, wherein the rigid plate is in direct physical contact with the piezoelectric transmitter element.

13. The zonal isolation device of claim 11, wherein the rigid plate extends between the piezoelectric transmitter element and the wellbore fluid when the zonal isolation device is positioned within the fluid conduit.

14. The zonal isolation device of claim 11, wherein, when the zonal isolation device is positioned within the fluid conduit and in the expanded conformation, the rigid plate at least one of:

(i) is in contact with a tubular body that defines the fluid conduit;

(ii) is in direct physical contact with the tubular body; and (iii) is separated from the tubular body by a gap.

15. The zonal isolation device of claim 1, wherein the wireless telemetry device further includes a wireless receiver configured to receive a wireless input signal.

16. The zonal isolation device of claim 1, wherein the zonal isolation device includes at least one of a swellable packer, an annular swellable packer, and a bridge plug.

17. The zonal isolation device of claim 1, wherein the wireless telemetry device is configured to receive a wireless input signal in the form of a wireless actuation signal, and further wherein the zonal isolation device includes a wirelessly triggered actuator configured to be transitioned between an unactuated configuration and an actuated configuration responsive to receipt of the wireless actuation signal.

18. The zonal isolation device of claim 17, wherein the wirelessly triggered actuator includes a wirelessly actuated valve that defines an open configuration, in which the wirelessly actuated valve permits fluid flow of the wellbore fluid therethrough, and a closed configuration, in which the wirelessly actuated valve resists fluid flow of the wellbore fluid therethrough, wherein the unactuated configuration defines the closed configuration, wherein the actuated configuration defines the open configuration, and further wherein, when in the open configuration, the wirelessly actuated valve is configured to facilitate fluid flow within the fluid conduit and past the zonal isolation device.

19. A method of conveying a wireless signal within a well, wherein the well includes a wellbore that extends within a subterranean formation, the method comprising:

detecting, with a sensor of a zonal isolation device, a property of the well;

transmitting an acoustic wireless output signal, which is indicative of the property of the well, with a wireless telemetry device of the zonal isolation device, wherein the zonal isolation device is positioned within a fluid conduit that extends within the wellbore, and wherein at least a portion of the sensor is in direct physical contact with a downhole tubular, which defines at least a portion of the fluid conduit, when the zonal isolation device is in an expanded conformation;

conveying the acoustic wireless output signal along a length of the wellbore; and receiving the acoustic wireless output signal with a relay node receiver of a relay node, wherein:

(i) the relay node is positioned within the fluid conduit; and (ii) the relay node is spaced-apart from the zonal isolation device along the length of the wellbore.

20. The method of claim 19, wherein the conveying includes conveying an entirety of the acoustic wireless output signal via a non-metallic conveyance medium over at least a portion of a transmission distance between the zonal isolation device and the relay node.

21. The method of claim 19, wherein the zonal isolation device and a tubular body, which defines the fluid conduit, define a gap therebetween, wherein a wellbore fluid fills the gap, and further wherein the conveying includes conveying the acoustic wireless output signal across the gap.

22. The method of claim 19, wherein the zonal isolation device includes a non-metallic isolation body configured to transition from a contracted conformation, in which a characteristic dimension of the non-metallic isolation body is less than a characteristic dimension of the fluid conduit such that the zonal isolation device is free to move within the fluid conduit, and an expanded conformation, in which the characteristic dimension of the non-metallic isolation body is greater than the characteristic dimension of the fluid conduit such that the isolation body is positionally fixed within the fluid conduit and restricts fluid flow of a wellbore fluid within the fluid conduit, and further wherein the zonal isolation device is in the expanded conformation.

23. The method of claim 22, wherein the fluid conduit is at least partially defined by a metallic downhole tubular that extends within the wellbore, wherein the zonal isolation device is in direct physical contact with the metallic downhole tubular, and further wherein the conveying includes conveying the entirety of the acoustic wireless output signal from the wireless telemetry device of the zonal isolation device, through the non-metallic isolation body of the zonal isolation device, into the metallic downhole tubular, and along the metallic downhole tubular to the relay node.

24. The method of claim 22, wherein the fluid conduit is at least partially defined by the wellbore, wherein the zonal isolation device is in direct physical contact with the wellbore, and further wherein the conveying includes conveying an entirety of the acoustic wireless output signal from the wireless telemetry device of the zonal isolation device via at least one of the wellbore fluid that extends within the wellbore, a subterranean formation that defines the wellbore, and a cement that extends within the wellbore.

25. The method of claim 19, wherein the detecting includes detecting at least one of:

(i) a property indicative of a seal integrity of the zonal isolation device within the fluid conduit;

(ii) a pressure drop across the zonal isolation device;

(iii) a property indicative of an integrity of the downhole tubular that at least partially defines the fluid conduit;

(iv) a temperature;

(v) a pressure;

(vi) a vibrational amplitude;

(vii) a vibrational frequency;

(viii) a strain within the zonal isolation device;

(ix) an electrical conductivity of a wellbore fluid;

(x) a flow rate of the wellbore fluid;

(xi) a presence of a multiphase flow within the fluid conduit;

(xii) a chemical composition of the wellbore fluid;

(xiii) a density of the wellbore fluid; and (xiv) a viscosity of the wellbore fluid.

* * * * *